US010725393B1

(12) United States Patent
Yamagishi et al.

(10) Patent No.: US 10,725,393 B1
(45) Date of Patent: Jul. 28, 2020

(54) TONER FOR ELECTROSTATIC IMAGE DEVELOPMENT, ELECTROSTATIC IMAGE DEVELOPER, AND TONER CARTRIDGE

(71) Applicant: FUJI XEROX CO., LTD., Tokyo (JP)

(72) Inventors: Yuka Yamagishi, Kanagawa (JP); Yutaka Saito, Kanagawa (JP); Kazuhiko Nakamura, Kanagawa (JP); Kazutsuna Sasaki, Kanagawa (JP); Takashi Inukai, Kanagawa (JP); Sakiko Takeuchi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/517,015

(22) Filed: Jul. 19, 2019

(30) Foreign Application Priority Data

Mar. 22, 2019 (JP) ..... 2019-054846

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 15/08*** | (2006.01) |
| ***G03G 9/093*** | (2006.01) |
| ***G03G 9/09*** | (2006.01) |

(52) U.S. Cl.

CPC ..... *G03G 9/09725* (2013.01); *G03G 9/0819* (2013.01); *G03G 9/08711* (2013.01); *G03G 9/08755* (2013.01); *G03G 9/093* (2013.01); *G03G 9/0906* (2013.01); *G03G 9/0975* (2013.01); *G03G 9/09708* (2013.01); *G03G 9/09741* (2013.01); *G03G 15/0865* (2013.01)

(58) Field of Classification Search

CPC ..... G03G 9/09725; G03G 9/09708; G03G 9/0819

USPC ..... 430/108.2, 108.6, 111.4

See application file for complete search history.

(56) References Cited

U.S. PATENT DOCUMENTS 9,804,518 B2 * 10/2017 Matsumoto ..... G03G 9/091

FOREIGN PATENT DOCUMENTS

JP 2008-151950 A 7/2008

OTHER PUBLICATIONS

"Test methods for acid value, saponification value, ester value, iodine value, hydroxyl value, and unsaponifiable matter of chemical products", Japanese Industrial Standard, JIS K0070-1992, May 1, 1992, 38 pgs.

"Testing Methods for Transition Temperatures of Plastics", Japanese Industrial Standard, JIS K 7121-1987, Jul. 20, 2012, 26 pgs.

* cited by examiner

*Primary Examiner* — Mark A Chapman

(74) *Attorney, Agent, or Firm* — Sughrue Mion, PLLC

(57) ABSTRACT

A toner for electrostatic image development includes: toner base particles containing at least a nonionic surfactant, a binder resin, and a release agent; and an external additive. The content of the nonionic surfactant is from 0.05% by mass to 1% by mass inclusive based on the total mass of the toner. The external additive contains inorganic particles having an arithmetic mean particle diameter of from 50 nm to 400 nm inclusive and an average circularity of from 0.5 to 0.8 inclusive.

14 Claims, 2 Drawing Sheets

TONER FOR ELECTROSTATIC IMAGE DEVELOPMENT, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2019-054846 filed Mar. 22, 2019.

BACKGROUND

(i) Technical Field

The present disclosure relates to a toner for electrostatic image development, to an electrostatic image developer, and to a toner cartridge.

(ii) Related Art

Visualization methods such as an electrophotographic method which visualize image information through electrostatic images are currently used in various fields.

In a conventional electrophotographic method commonly used, image information is visualized through the steps of: forming electrostatic latent images on photoconductors or electrostatic recording mediums using various means; causing electroscopic particles referred to as toner to adhere to the electrostatic latent images to develop the electrostatic latent images (toner images); transferring the developed images onto the surface of a transfer body; and fixing the images by, for example, heating.

One known conventional toner is disclosed in Japanese Unexamined Patent Application Publication No. 2008-151950.

Japanese Unexamined Patent Application Publication No. 2008-151950 discloses a toner for electrophotography containing a binder resin containing polyester, a nonionic surfactant, and an external additive, wherein the content of the nonionic surfactant is 0.05 to 0.5% by weight, and wherein the external additive contains negatively chargeable inorganic fine particles having a number average particle diameter of 0.005 to 0.05 μm and positively chargeable organic fine particles having a number average particle diameter of 0.1 to 0.6 μm.

SUMMARY

Aspects of non-limiting embodiments of the present disclosure relate to a toner, for electrostatic image development, that form images with less density unevenness than images obtained using a toner in which the content of the nonionic surfactant contained in toner base particles is less than 0.05% by mass or more than 1% by mass based on the total mass of the toner or than images obtained using a toner containing, as the external additive, only inorganic particles with an arithmetic mean particle diameter of less than 50 nm or more than 400 nm or with an average circularity of less than 0.5 or more than 0.8.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner, for electrostatic image development, containing: toner base particles containing at least a nonionic surfactant, a binder resin, and a release agent; and an external additive, wherein the content of the nonionic surfactant is from 0.05% by mass to 1% by mass inclusive based on the total mass of the toner, and wherein the external additive contains inorganic particles with an arithmetic mean particle diameter of from 50 nm to 400 nm inclusive and an average circularity of from 0.5 to 0.8 inclusive.

BRIEF DESCRIPTION OF THE DRAWINGS

Exemplary embodiments of the present disclosure will be described in detail based on the following figures, wherein.

DETAILED DESCRIPTION

Figure 1:
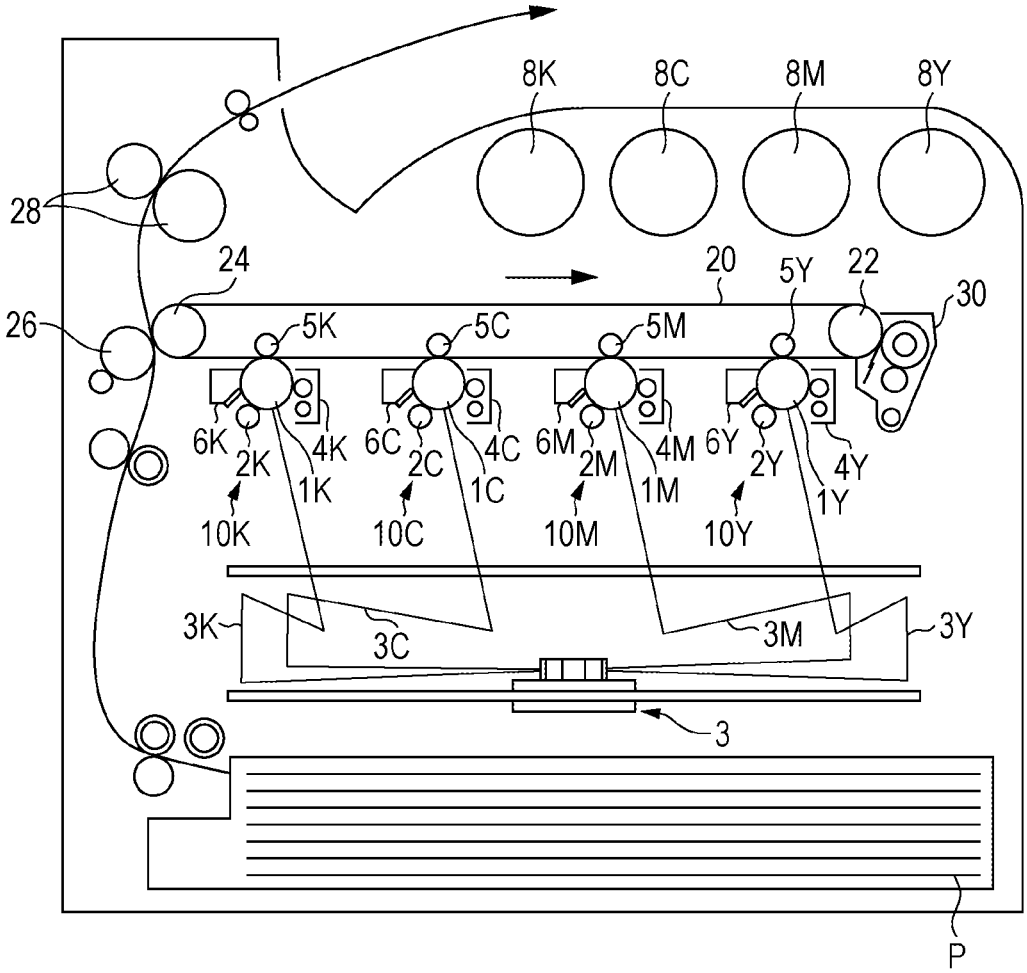
FIG. 1 is a schematic configuration diagram showing an image forming apparatus according to an exemplary embodiment.

In exemplary embodiments of the disclosure, when reference is made to the amount of a component in a composition, if the composition contains a plurality of materials corresponding to the above component, the above amount means the total amount of the plurality of materials, unless otherwise specified.

In the exemplary embodiments of the disclosure, the "toner for electrostatic image development" may be referred to simply as a "toner," and the "electrostatic image developer" may be referred to simply as a "developer."

The exemplary embodiments of the present disclosure will be described.

<Toner for Electrostatic Image Development>

A toner for electrostatic image development according to an exemplary embodiment contains: toner base particles containing at least a nonionic surfactant, a binder resin, and a release agent; and an external additive. The content of the nonionic surfactant is from 0.05% by mass to 1% by mass inclusive based on the total mass of the toner. The external additive contains inorganic particles with an arithmetic mean particle diameter of from 50 nm to 400 nm inclusive and an average circularity of from 0.5 to 0.8 inclusive.

It has been known that, when a large-diameter external additive having an odd shape is used for a conventional toner, the external additive exhibits an effect in providing good transferability because the external additive has many points of contact with the toner, tends not to roll, and is therefore unlikely to be unevenly distributed in recessed portions of the toner even under agitation stress in a developing unit during printing. However, although this external additive does no roll under agitation stress, its dispersibility on the surfaces of components forming the toner during production of the toner is poor. Therefore, when the degree of embedding of the external additive into the toner base particles increases, image density unevenness, particularly density unevenness due to failure of secondary transfer of the toner, occurs.

The toner for electrostatic image development according to the present exemplary embodiment is configured as described above and can form images with reduced density unevenness. Although the reason for this is unclear, the reason may be as follows.

When the external additive contains the inorganic particles having an arithmetic mean particle diameter of from 50 nm to 400 nm inclusive and an average circularity of 0.5 to 0.8 and the toner base particles contain the nonionic surfactant in an amount within the above-described range, the nonionic surfactant adsorbs around the components forming the toner during production of the toner, and this allows the surface dispersibility of the components to be maintained. Therefore, in the toner obtained, the components of the toner are distributed uniformly, and the external additive also adheres uniformly to these components. In this case, the transferability of the toner is high, and density unevenness in images to be obtained is small.

The toner for electrostatic image development according to the present exemplary embodiment will be described in detail.

The toner according to the present exemplary embodiment is configured to include toner base particles (which may be referred to also as "toner particles") and an optional external additive.

(External Additive)

The toner for electrostatic image development according to the present exemplary embodiment contains the external additive, and the external additive contains inorganic particles (which are hereinafter referred to also as a "specific external additive") with an arithmetic mean particle diameter of from 50 nm to 400 nm inclusive and an average circularity of from 0.5 to 0.8 inclusive.

The arithmetic mean particle diameter of the specific external additive is from 50 nm to 400 nm inclusive. From the viewpoint of reducing density unevenness in images to be obtained, the arithmetic mean particle diameter of the specific external additive is more preferably from 80 nm to 350 nm inclusive and particularly preferably from 200 nm to 300 nm inclusive.

To measure the arithmetic mean particle diameter of the specific external additive in the present exemplary embodiment, the specific external additive is observed under a scanning electron microscope (S-4100 manufactured by Hitachi, Ltd.) to take an image. The image taken is introduced into an image analyzer (LUZEX III manufactured by NIRECO CORPORATION). The areas of particles are determined by image analysis, and circle-equivalent diameters (nm) are determined from the areas determined. The arithmetic mean of the circle-equivalent diameters of at least 100 particles is computed and used as the arithmetic mean particle diameter.

The average circularity of the specific external additive is from 0.5 to 0.8 inclusive. From the viewpoint of reducing density unevenness in images to be obtained, the average circularity is preferably from 0.52 to 0.78 inclusive, more preferably from 0.55 to 0.75 inclusive, and particularly preferably from 0.58 to 0.72 inclusive.

The average circularity of the specific external additive is computed by the following method.

The surface of the toner base particles is observed under a scanning electron microscope (SEM) at a magnification of 40,000×. Specifically, at least 100 specific external additive particles on the peripheries of the toner particles are observed, and the images of the observed specific external additive particles are analyzed using image processing analysis software WinRoof (manufactured by MITANI CORPORATION). The circularities of at least 100 particles obtained by image analysis on the external additive primary particles are averaged to compute the average circularity.

The circularity is computed using the following formula.

$$\text{Circularity}=\text{peripheral length of equivalent circle}/\text{peripheral length}=[2\times(A\pi)^{1/2}]/PM$$

In the above formula, A represents the projected area, and PM represents the peripheral length.

The specific external additive is inorganic particles, and examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

In particular, from the viewpoint of reducing density unevenness in images to be obtained, the specific external additive is preferably silica particles or titania particles and more preferably silica particles.

The surface of the specific external additive may be subjected to hydrophobic treatment. The hydrophobic treatment is performed, for example, by immersing the inorganic particles in a hydrophobic treatment agent. No particular limitation is imposed on the hydrophobic treatment agent, and examples of the hydrophobic treatment agent include silane-based coupling agents, silicone oils, titanate-based coupling agents, and aluminum-based coupling agents. Any of these may be used alone or in combination of two or more.

The amount of the specific external additive added externally is, for example, preferably from 0.01% by mass to 10% by mass inclusive and more preferably from 0.01% by mass to 6% by mass inclusive based on the mass of the toner base particles.

The toner for electrostatic image development according to the present exemplary embodiment may contain an additional external additive other than the specific external additive described above.

Examples of the additional external additive include inorganic particles other than the specific external additive. Examples of the material of the additional external additive include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and $SrTiO_3$.

The surface of the inorganic particles used as the additional external additive may be subjected to hydrophobic treatment. The hydrophobic treatment is performed, for example, by immersing the inorganic particles in a hydrophobic treatment agent. No particular limitation is imposed on the hydrophobic treatment agent, and examples of the hydrophobic treatment agent include silane-based coupling agents, silicone oils, titanate-based coupling agents, and aluminum-based coupling agents. Any of these may be used alone or in combination of two or more.

The amount of the hydrophobic treatment agent may be, for example, from 1 part by mass to 10 parts by mass inclusive based on 100 parts by mass of the inorganic particles.

Other examples of the additional external additive include resin particles (particles of resins such as polystyrene, polymethyl methacrylate (PMMA), and melamine resins) and cleaning activators (such as metal salts of higher fatty acids typified by zinc stearate and fluorine-based polymer particles).

The amount of the additional external additive added externally is, for example, preferably from 0.01% by mass to 10% by mass inclusive and more preferably from 0.01% by mass to 6% by mass inclusive based on the mass of the toner base particles.

From the viewpoint of reducing density unevenness in images to be obtained, it is preferable that the amount of the additional external additive added externally is less than the amount of the specific external additive added externally.

(Toner Base Particles)

The toner base particles contain, for example, a nonionic surfactant, a binder resin, and a release agent and optionally contains a coloring agent and additional additives. Preferably, the toner base particles contain a nonionic surfactant, a binder resin, a coloring agent, and a release agent.

—Nonionic Surfactant—

The toner base particles contain a nonionic surfactant, and the content of the nonionic surfactant is from 0.05% by mass to 1% by mass inclusive based on the total mass of the toner.

No particular limitation is imposed on the nonionic surfactant, and any known nonionic surfactant may be used. Specific examples of the nonionic surfactant include polyoxyethylene alkyl ethers, polyoxyethylene aryl ethers, glycerin fatty acid partial esters, sorbitan fatty acid partial esters, pentaerythritol fatty acid partial esters, propylene glycol mono-fatty acid esters, sucrose fatty acid partial esters, polyoxyethylene sorbitan fatty acid partial esters, polyoxyethylene sorbitol fatty acid partial esters, polyethylene glycol fatty acid esters, polyglycerin fatty acid partial esters, polyoxyethylene glycerin fatty acid partial esters, fatty acid diethanol amides, N,N-bis-2-hydroxyalkylamines, polyoxyethylene alkylamines, triethanolamine fatty acid esters, and trialkyl amine oxides.

Other examples of the nonionic surfactant include silicone-based surfactants and fluorine-based surfactants.

In particular, from the viewpoint of reducing density unevenness in images to be obtained, the nonionic surfactant is preferably a compound having a polyalkyleneoxy structure, more preferably a compound having a polyethyleneoxy structure, still more preferably a polyoxyethylene alkyl ether compound or a polyoxyethylene aryl ether compound, and particularly preferably a polyoxyethylene lauryl ether compound or a polyoxyethylene distyrenated phenyl ether compound.

From the viewpoint of reducing density unevenness in images to be obtained, the nonionic surfactant is preferably a polyoxyethylene (the average number of moles added: from 10 moles to 60 moles inclusive) alkyl (the number of carbon atoms: from 8 to 18 inclusive) ether compound and more preferably a polyoxyethylene alkyl ether compound in which the alkyl group has 12 to 18 carbon atoms and the average number of moles added is from 12 to 18 inclusive. Specific particularly preferred examples of the nonionic surfactant include polyoxyethylene oleyl ether, polyoxyethylene stearyl ether, and polyoxyethylene lauryl ether.

A commercial nonionic surfactant may be used.

Examples of the commercial product include: EMULGEN 150, EMULGEN A-60, and EMULGEN A-90 (manufactured by Kao Corporation); and a fluorine-based surfactant SURFLON S-241 (manufactured by AGC SEIMI CHEMICAL Co., Ltd.).

The toner base particles may contain only one type of nonionic surfactant or may contain two or more types of nonionic surfactants.

The content of the nonionic surfactant is from 0.05% by mass to 1% by mass inclusive based on the total mass of the toner. From the viewpoint of reducing density unevenness in images to be obtained, the content is preferably from 0.08% by mass to 0.95% by mass inclusive, more preferably from 0.1% by mass to 0.9% by mass inclusive, still more preferably from 0.2% by mass to 0.8% by mass inclusive, and particularly preferably from 0.3% by mass to 0.7% by mass inclusive.

Preferably, 50% by mass or more of the nonionic surfactant contained in the toner for electrostatic image development according to the present exemplary embodiment is a compound having a polyalkyleneoxy structure. More preferably, 80% by mass or more of the nonionic surfactant is the compound having a polyalkyleneoxy structure. Still more preferably, 90% by mass or more of the nonionic surfactant is the compound having a polyalkyleneoxy structure. Particularly preferably, 100% by mass of the nonionic surfactant is the compound having a polyalkyleneoxy structure.

—Binder Resin—

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

Of these, styrene-acrylic copolymers and polyester resins are preferably used, and polyester resins are more preferably used.

Any of these binder resins may be used alone or in combination of two or more.

The binder resin may be an amorphous (non-crystalline) resin or a crystalline resin.

From the viewpoint of reducing density unevenness in images to be obtained, it is preferable that the binder resin contains a crystalline resin, and it is more preferable that the binder resin contains an amorphous resin and a crystalline resin.

The content of the crystalline resin is preferably from 2% by mass to 40% by mass inclusive and more preferably from 2% by mass to 20% by mass inclusive based on the total mass of the binder resin.

The "crystalline" resin means that, in differential scanning calorimetry (DSC), a clear endothermic peak is observed instead of a stepwise change in the amount of heat absorbed. Specifically, the half width of the endothermic peak when the measurement is performed at a heating rate of 10 (° C./min) is 10° C. or less.

The "amorphous" resin means that the half width exceeds 10° C., that a stepwise change in the amount of heat absorbed is observed, or that a clear endothermic peak is not observed.

<<Composite Resin>>

From the viewpoint of reducing density unevenness in images to be obtained, it is preferable that the binder resin contains an amorphous resin having a polyester resin segment and an addition polymerized resin segment (this amorphous resin is hereinafter referred to also as a "composite resin"), and it is more preferable that the binder resin contains an amorphous resin having a polyester resin segment and a styrene-acrylic copolymer segment.

[Polyester Resin Segment]

The polyester resin segment in the composite resin is, for example, a polycondensation product of an alcohol component (a-al) and a carboxylic acid component (a-ac). Since the composite resin has the polyester resin segment, the toner obtained can have excellent low-temperature fixability.

Examples of the alcohol component (a-al) include linear and branched aliphatic diols, aromatic diols, alicyclic diols, and trihydric and higher polyhydric alcohols. Of these, aromatic diols are preferable. From the viewpoint of improving low-temperature fixability and the image density of a printed material, an alkylene oxide adduct of bisphenol A is more preferable.

The alkylene oxide adduct of bisphenol A is preferably at least one selected from the group consisting of an ethylene oxide adduct of bisphenol A (2,2-bis(4-hydroxyphenyl)propane) and a propylene oxide adduct of bisphenol A and is more preferably a propylene oxide adduct of bisphenol A.

The average number of moles of alkylene oxide added in the alkylene oxide adduct of bisphenol A is preferably 1 or more, more preferably 1.2 or more, and still more preferably 1.5 or more and is preferably 16 or less, more preferably 12 or less, still more preferably 8 or less, and particularly preferably 4 or less.

The amount of the alkylene oxide adduct of bisphenol A in the alcohol component (a-al) is preferably 80% by mole or more, more preferably 90% by mole or more, still more preferably 95% by mole or more, particularly preferably from 98% by mole to 100% by mole inclusive, and most preferably 100% by mole.

The alcohol component (a-al) may contain an additional alcohol component other than the alkylene oxide adduct of bisphenol A. Examples of the additional alcohol component include linear and branched aliphatic diols, other aromatic diols, alicyclic diols, and trihydric and higher polyhydric alcohols.

Examples of the linear and branched aliphatic diols include ethylene glycol, 1,2-propanediol, 1,3-propanediol, 1,2-butanediol, 1,3-butanediol, 1,4-butanediol, 2,3-butanediol, 2,2-dimethyl-1,3-propanediol, 1,6-hexanediol, 1,8-octanediol, 1,9-nonanediol, 1,10-decanediol, and 1,12-dodecanediol.

Examples of the alicyclic diols include hydrogenated bisphenol A (2,2-bis(4-hydroxycyclohexyl)propane) and alkylene (having 2 to 4 carbon atoms) oxide adducts (the average number of moles added: 2 to 12) of hydrogenated bisphenol A.

Examples of the trihydric and higher polyhydric alcohols include glycerin, pentaerythritol, trimethylolpropane, and sorbitol.

Any of these alcohol components may be used alone or in combination of two or more.

Examples of the carboxylic acid component (a-ac) include dicarboxylic acids and tricarboxylic and higher carboxylic acids.

Examples of the dicarboxylic acids include aromatic dicarboxylic acids, linear and branched aliphatic dicarboxylic acid, and alicyclic dicarboxylic acids. In particular, at least one compound selected from the group consisting of aromatic dicarboxylic acids and linear and branched aliphatic dicarboxylic acids is preferable.

Examples of the aromatic dicarboxylic acids include phthalic acid, isophthalic acid, and terephthalic acid. In particular, at least one compound selected from the group consisting of isophthalic acid and terephthalic acid is preferred, and terephthalic acid is more preferred.

The amount of the aromatic dicarboxylic acid in the carboxylic acid component (a-ac) is preferably 20% by mole or more, more preferably 25% by mole or more, and still more preferably 30% by mole or more and is preferably 90% by mole or less, more preferably 70% by mole or less, and still more preferably 50% by mole or less.

The number of carbon atoms in the linear or branched aliphatic dicarboxylic acid is preferably 2 or more and more preferably 3 or more and is preferably 30 or less and more preferably 20 or less.

Examples of the linear or branched aliphatic dicarboxylic acid having 2 to 30 carbon atoms include oxalic acid, malonic acid, maleic acid, fumaric acid, citraconic acid, itaconic acid, glutaconic acid, succinic acid, adipic acid, sebacic acid, dodecanedioic acid, azelaic acid, and succinic acid substituted by an alkyl group having 1 to 20 carbon atoms or an alkenyl group having 2 to 20 carbon atoms.

Examples of the succinic acid substituted by an alkyl group having 1 to 20 carbon atoms or an alkenyl group having 2 to 20 carbon atoms include dodecyl succinic acid, dodecenyl succinic acid, and octenyl succinic acid.

In particular, at least one compound selected from the group consisting of terephthalic acid, sebacic acid, and fumaric acid is preferred, and it is more preferable to use a combination of two or more of them.

The tricarboxylic or higher carboxylic acid may be a tricarboxylic acid, and examples thereof include trimellitic acid.

When the tricarboxylic or higher carboxylic acid is contained, the amount of the tricarboxylic or higher carboxylic acid in the carboxylic acid component (a-ac) is preferably 3% by mole or more and more preferably 5% by mole or more and is preferably 20% by mole or less, more preferably 15% by mole or less, and still more preferably 12% by mole or less.

Any of these carboxylic acid components may be used alone or in combination of two or more.

The ratio of the carboxy groups in the carboxylic acid component (a-ac) to the hydroxyl groups in the alcohol component (a-al), [COOH groups/OH groups], is preferably 0.7 or more and more preferably 0.8 or more and is preferably 1.3 or less and more preferably 1.2 or less.

[Addition Polymerized Resin Segment]

From the viewpoint of reducing density unevenness in images to be obtained, the addition polymerized resin segment is preferably a styrene resin segment or a styrene-acrylic copolymer segment and more preferably a styrene-acrylic copolymer segment.

From the viewpoint of further improving the image density of a printed material, the addition polymerized resin segment is preferably a segment of a copolymer of styrene and a vinyl-based monomer having an aliphatic hydrocarbon group.

The styrene-based compound used to form the addition polymerized resin segment may be, for example, substituted or unsubstituted styrene. Examples of the substituent include alkyl groups having 1 to 5 carbon atoms, halogen atoms, alkoxy groups having 1 to 5 carbon atoms, a sulfonic acid group, and salts thereof.

Examples of the styrene-based compound include styrenes such as styrene, methylstyrene, α-methylstyrene, β-methylstyrene, tert-butylstyrene, chlorostyrene, chloromethylstyrene, methoxystyrene, styrene sulfonic acid, and salts thereof.

Of these, styrene is preferred.

From the viewpoint of reducing density unevenness in images to be obtained, the amount of the styrene-based compound, preferably styrene, in the raw material monomers of the addition polymerized resin segment is preferably from 50% by mass to 95% by mass inclusive, more preferably from 55% by mass to 90% by mass inclusive, and particularly preferably from 60% by mass to 85% by mass inclusive.

From the viewpoint of reducing density unevenness in images to be obtained, the content of the styrene-based compound, preferably a monomer unit originating from styrene (which may be referred to also as a "monomer unit formed from styrene"), is preferably from 50% by mass to 95% by mass inclusive, more preferably from 55% by mass to 90% by mass inclusive, and particularly preferably from 60% by mass to 85% by mass inclusive based on the total mass of the addition polymerized resin segment.

In the vinyl-based monomer having an aliphatic hydrocarbon group, the number of carbon atoms in the hydrocarbon group is preferably 1 or more, more preferably 6 or more, still more preferably 10 or more, and particularly preferably 14 or more and is preferably 22 or less, more preferably 20 or less, and still more preferably 18 or less, from the viewpoint of further improving the image density of a printed material.

When a vinyl-based monomer having a long-chain aliphatic hydrocarbon group having 8 or more carbon atoms is contained as a raw material monomer, a clear phase separation microstructure is formed in the composite resin, and the vinyl-based monomer easily interacts with coloring agent particles. Therefore, the dispersibility of the coloring agent is further improved, and the low-temperature fixability and the image density are improved.

Examples of the aliphatic hydrocarbon group include alkyl groups, alkynyl groups, and alkenyl groups. The aliphatic hydrocarbon group is preferably an alkyl group or an alkenyl group and more preferably an alkyl group. The aliphatic hydrocarbon group may be linear or branched.

One of the monomers used to form the addition polymerized resin segment is preferably a (meth)acrylic compound, more preferably a (meth)acrylate compound, and particularly preferably an alkyl ester of (meth)acrylic acid. In the alkyl ester of (meth)acrylic acid, the hydrocarbon group is a residue on the alcohol side of the ester.

Examples of the alkyl ester of (meth)acrylic acid include (iso)propyl (meth)acrylate, (iso)butyl (meth)acrylate, (iso)hexyl (meth)acrylate, cyclohexyl (meth)acrylate, (iso)octyl (meth)acrylate (hereinafter referred to also as 2-ethylhexyl (meth)acrylate), (iso)decyl (meth)acrylate, (iso)dodecyl (meth)acrylate (hereinafter referred to also (iso)lauryl (meth)acrylate), (iso)palmityl (meth)acrylate, (iso)stearyl (meth)acrylate, and (iso)behenyl (meth)acrylate.

Of these, 2-ethylhexyl (meth)acrylate, (iso)decyl (meth)acrylate, (iso)dodecyl (meth)acrylate, (iso)stearyl (meth)acrylate, and (iso)behenyl (meth)acrylate are preferred, and 2-ethylhexyl (meth)acrylate, (iso)dodecyl (meth)acrylate, and (iso)stearyl (meth)acrylate are more preferred. (Iso)dodecyl (meth)acrylate and (iso)stearyl (meth)acrylate are still more preferred, and (iso)stearyl (meth)acrylate is yet more preferred.

The "alkyl (meth)acrylate" represents alkyl acrylate and alkyl methacrylate. The prefix "(iso)" in front of an alkyl moiety means that the alkyl moiety is a normal alkyl or isoalkyl moiety.

From the viewpoint of reducing density unevenness in images to be obtained, the amount of the (meth)acrylic compound in the raw material monomers of the addition polymerized resin segment is preferably from 5% by mass to 50% by mass inclusive, more preferably from 10% by mass to 45% by mass inclusive, and particularly preferably from 150% by mass to 40% by mass inclusive.

From the viewpoint of reducing density unevenness in images to be obtained, the content of the structural unit originating from the (meth)acrylic compound is preferably from 5% by mass to 50% by mass inclusive, more preferably from 10% by mass to 45% by mass inclusive, and particularly preferably from 15% by mass to 40% by mass inclusive based on the total mass of the addition polymerized resin segment.

Examples of other raw material monomers include: ethylenically unsaturated monoolefins such as ethylene and propylene; conjugated dienes such as butadiene; halovinyls such as vinyl chloride; vinyl esters such as vinyl acetate and vinyl propionate; aminoalkyl esters of (meth)acrylic acid such as dimethylaminoethyl (meth)acrylate; vinyl ethers such as methyl vinyl ether; vinylidene halides such as vinylidene chloride; and N-vinyl compounds such as N-vinylpyrrolidone.

[Unit Originating from Bireactive Monomer]

From the viewpoint of obtaining high image density in a printed material, the composite resin has a unit originating from a bireactive monomer. When the bireactive monomer is used as a raw material monomer of the composite resin, the bireactive monomer reacts with the polyester resin segment and the addition polymerized resin segment or with raw material monomers of these segments and forms a bonding point between the polyester resin segment and the addition polymerized resin segment.

The "unit originating from a bireactive monomer" means a unit reacted with a functional group in the bireactive monomer or its vinyl moiety.

The bireactive monomer is, for example, a vinyl-based monomer having in its molecule at least one functional group selected from the group consisting of a hydroxy group, a carboxy group, an epoxy group, a primary amino group, and a secondary amino group. In particular, from the viewpoint of reactivity, the bireactive monomer is preferably a vinyl-based monomer having a hydroxy group or a carboxy group and more preferably a vinyl-based monomer having a carboxy group.

Examples of the bireactive monomer include acrylic acid, methacrylic acid, fumaric acid, and maleic acid. Of these, from the viewpoint of reactivity in a polycondensation reaction and an addition polymerization reaction, acrylic acid and methacrylic acid are preferred, and acrylic acid is more preferred.

From the viewpoint of further improving the image density of a printed material, the content of the unit originating from the bireactive monomer is preferably 1 part by mole or more, more preferably 5 parts by mole or more, and still more preferably 8 parts by mole or more based on 100 parts by mole of the alcohol component in the polyester resin segment in the composite resin and is preferably 30 parts by mole or less, more preferably 25 parts by mole or less, and still more preferably 20 parts by mole or less. When the bireactive monomer is used, the amounts of the segments in the composite resin are computed on the assumption that the structural unit originating from the bireactive monomer is contained in the polyester resin segment.

From the viewpoint of reducing density unevenness in images to be obtained, the amount of the polyester resin segment in the composite resin is preferably 40% by mass or more, more preferably 50% by mass or more, and still more preferably 55% by mass or more based on the total mass of the composite resin and is preferably 95% by mass or less, more preferably 85% by mass or less, and still more preferably 80% by mass or less.

From the viewpoint of reducing density unevenness in images to be obtained, the amount of the addition polymerized resin segment in the composite resin is preferably 10% by mass or more, more preferably 15% by mass or more, and still more preferably 20% by mass or more based on the total mass of the composite resin and is preferably 60% by mass or less, more preferably 50% by mass or less, and still more preferably 45% by mass or less.

From the viewpoint of reducing density unevenness in images to be obtained, the total amount of the polyester resin segment and the addition polymerized resin segment in the composite resin is preferably from 80% by mass to 100% by mass inclusive, more preferably from 90% by mass to 100% by mass inclusive, still more preferably from 93% by mass to 100% by mass inclusive, and particularly preferably from 95% by mass to 100% by mass inclusive based on the total mass of the composite resin.

From the viewpoint of reducing density unevenness in images to be obtained, the softening temperature Tm of the composite resin is preferably 70° C. or higher, more preferably 90° C. or higher, and still more preferably 100° C. or higher and is preferably 140° C. or lower, more preferably 130° C. or lower, and still more preferably 125° C. or lower.

The softening temperature Tm of a resin is measured using a flow tester (CFT-500C manufactured by Shimadzu Corporation) with a nozzle having a diameter of 1 mm and a length of 1 mm at a load of 10 kgf/cm$^2$ and a heating rate of 6° C./minute after preheating at 80° C. for 5 minutes. 1 g of a sample is subjected to the measurement to determine a curve representing the amount of descent of a plunger of the flow tester versus temperature, and the softening temperature is defined as a temperature (½ outflow temperature) at one-half the height of a S-shaped curve in the curve determined.

From the viewpoint of reducing density unevenness in images to be obtained, the glass transition temperature of the composite resin is preferably 30° C. or higher, more preferably 35° C. or higher, and still more preferably 40° C. or higher and is preferably 70° C. or lower, more preferably 60° C. or lower, and still more preferably 55° C. or lower.

The glass transition temperature Tg of a resin is measured using a method described later.

From the viewpoint of reducing density unevenness in images to be obtained, the acid value of the composite resin is preferably 5 mg KOH/g or more, more preferably 10 mg KOH/g or more, and still more preferably 15 mg KOH/g or more and is preferably 40 mg KOH/g or less, more preferably 35 mg KOH/g or less, and still more preferably 30 mg KOH/g or less.

The acid value is the number of milligrams of potassium hydroxide necessary to neutralize acid groups (e.g., carboxy groups) in 1 gram of a sample. In the present exemplary embodiment, the acid value is measured according to a method defined in JIS K0070-1992 (potentiometric titration method).

When the sample is in a neutralized state, the sample is subjected to a reduced pressure environment (and optionally heated) to remove the neutralizer or subjected to acid treatment to thereby recover the original acid groups (e.g., carboxy groups), and then the acid value is measured. If the sample is not dissolved, a solvent such as dioxane or tetrahydrofuran (THF) is used.

The softening point, glass transition temperature, and acid value of the composite resin can be appropriately controlled by changing the types and amounts of the raw material monomers used and production conditions such as reaction temperature, reaction time, and cooling rate, and the values of them can be determined by methods described in Examples.

When two or more composite resins are used in combination, the softening point, glass transition temperature, and acid value of the mixture may be within the above-described ranges.

A method for producing the composite resin includes, for example: subjecting the alcohol component (a-al) and the carboxylic acid component (a-ac) to polycondensation; and subjecting the raw material monomers of the addition polymerized resin segment and the bireactive monomer to an addition polymerization reaction. Specific examples of the method include the following methods (i) to (iii).

(i) A method including: subjecting the alcohol component (a-al) and the carboxylic acid component (a-ac) to a polycondensation reaction; and then subjecting the raw material monomers of the addition polymerized resin segment and the bireactive monomer to an addition polymerization reaction From the viewpoint of reactivity, the raw material monomers of the addition polymerized resin segment, together with the bireactive monomer, may be supplied to the reaction system. From the viewpoint of reactivity, a catalyst such as an esterification catalyst or an esterification promoter may be used, and a radical polymerization initiator and a radical polymerization inhibitor may also be used.

From the viewpoint of facilitating the polycondensation reaction and optionally the reaction with the bireactive monomer, part of the carboxylic acid component may be used for the polycondensation reaction. In this case, after the addition polymerization reaction is performed, the reaction temperature is again increased, and the rest of the carboxylic acid component is added to the reaction system.

The composite resin can be produced by the following methods (ii) and (iii).

(ii) A method including: subjecting the raw material monomers of the addition polymerized resin segment and the bireactive monomer to the addition polymerization reaction; and then subjecting the raw material monomers of the polyester resin segment to the polycondensation reaction (iii) A method including: subjecting the alcohol component and the carboxylic acid component to the polycondensation reaction; and simultaneously subjecting the raw material monomers of the addition polymerized resin segment and the bireactive monomer to the addition polymerization reaction The polycondensation reaction and the addition polymerization reaction in the methods (i) to (iii) may be performed in the same container.

It is preferable that the composite resin is produced by the method (i) or (ii) because the flexibility in the reaction temperature of the polycondensation reaction is high, and it is more preferable to use the method (i).

In the polycondensation reaction, the alcohol component (a-al) and the carboxylic acid component (a-ac) are subjected to polycondensation. In the polycondensation, an esterification catalyst such as di(2-ethylhexanoic acid)tin (II), dibutyltin oxide, or titanium diisopropylate bistriethanolaminate may be optionally used in an amount of from 0.01 parts by mass to 5 parts by mass inclusive based on 100 parts by mass of the total of the alcohol component and the carboxylic acid component, and an esterification promoter such as gallic acid (which is the same as 3,4,5-trihydroxy benzoic acid) may be optionally used in an amount of from 0.001 parts by mass to 0.5 parts by mass inclusive based on 100 parts by mass of the total of the alcohol component and the carboxylic acid component. Moreover, a radical polymerization inhibitor such as 4-tert-butylcatechol may be optionally used in an amount of from 0.001 parts by mass to 0.5 parts by mass inclusive based on 100 parts by mass of the total of the alcohol component and the carboxylic acid component.

The temperature during the polycondensation reaction is preferably 120° C. or higher, more preferably 160° C. or higher, and still more preferably 180° C. or higher and is preferably 250° C. or lower and more preferably 230° C. or lower.

The polycondensation may be performed in an inert gas atmosphere.

In the addition polymerization reaction, the raw material monomers of the addition polymerized resin segment and the bireactive monomer are subjected to addition polymerization.

The temperature during the addition polymerization reaction is preferably 110° C. or higher and more preferably 130° C. or higher and is preferably 220° C. or lower and more preferably 200° C. or lower. The pressure of the reaction system may be reduced in the latter half of the polymerization to thereby facilitate the reaction.

The polymerization initiator used for the addition polymerization reaction may be a well-known radical polymerization initiator such as a peroxide such as dibutyl peroxide, a persulfate such as sodium persulfate, or an azo compound such as 2,2'-azobis(2,4-dimethylvaleronitrile).

The amount of the radical polymerization initiator used is preferably 1 part by mass or more and more preferably 5 parts by mass or more based on 100 parts by weight of the raw material monomers of the addition polymerized resin segment and is preferably 20 parts by mass or less and more preferably 15 parts by mass or less.

<<Polyester Resin>>

The polyester resin may be, for example, a well-known polyester resin.

In the binder resin, a crystalline polyester resin may be used in combination with an amorphous polyester resin or a non-crystalline resin having the polyester resin segment and the addition polymerized segment (preferably a styrene-acrylic copolymer segment). The content of the crystalline polyester resin is preferably from 2% by mass to 40% by mass inclusive and more preferably from 2% by mass to 20% by mass inclusive based on the total mass of the binder resin.

—Amorphous Polyester Resin

The amorphous polyester resin may be, for example, a polycondensation product of a polycarboxylic acid and a polyhydric alcohol. The amorphous polyester resin used may be a commercial product or a synthesized product.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (e.g., having 1 to 5 carbon atoms) esters thereof. In particular, the polycarboxylic acid is, for example, preferably an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (e.g., having 1 to 5 carbon atoms) esters thereof.

Any of these polycarboxylic acids may be used alone or in combination of two or more.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

Any of these polyhydric alcohols may be used alone or in combination or two or more.

The glass transition temperature (Tg) of the amorphous polyester resin is preferably from 50° C. to 80° C. inclusive and more preferably from 50° C. to 65° C. inclusive.

The glass transition temperature is determined from a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

The weight average molecular weight (Mw) of the amorphous polyester resin is preferably from 5,000 to 1,000,000 inclusive and more preferably from 7,000 to 500,000 inclusive.

The number average molecular weight (Mn) of the amorphous polyester resin may be from 2,000 to 100,000 inclusive.

The molecular weight distribution Mw/Mn of the amorphous polyester resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The amorphous polyester resin can be obtained by a well-known production method. For example, in one production method, the polymerization temperature is set to from 180° C. to 230° C. inclusive. If necessary, the pressure of the reaction system is reduced, and the reaction is allowed to proceed while water and alcohol generated during condensation are removed.

When raw material monomers are not dissolved or not compatible with each other at the reaction temperature, a high-boiling point solvent serving as a solubilizer may be added to dissolve the monomers. In this case, the polycondensation reaction is performed while the solubilizer is removed by evaporation. When a monomer with poor compatibility is present, the monomer with poor compatibility and an acid or an alcohol to be polycondensed with the monomer are condensed in advance and then the resulting polycondensation product and the rest of the components are subjected to polycondensation.

Crystalline Polyester Resin

The crystalline polyester resin is, for example, a polycondensation product of a polycarboxylic acid and a polyhydric alcohol. The crystalline polyester resin used may be a commercial product or a synthesized product.

The crystalline polyester resin is preferably a polycondensation product using a polymerizable monomer having a linear aliphatic group rather than using a polymerizable monomer having an aromatic group, in order to facilitate the formation of a crystalline structure.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (such as dibasic acids such as phthalic acid, isophthalic acid, terephthalic acid, and naphthalene-2,6-dicarboxylic acid), anhydrides thereof, and lower alkyl (e.g., having 1 to 5 carbon atoms) esters thereof.

The polycarboxylic acid used may be a combination of a dicarboxylic acid and a tricarboxylic or higher polycarboxylic acid having a crosslinked or branched structure. Examples of the tricarboxylic acid include aromatic carboxylic acids (such as 1,2,3-benzenetricarboxylic acid, 1,2,4-benzenetricarboxylic acid, and 1,2,4-naphthalene tricarboxylic acid), anhydrides thereof, and lower alkyl (e.g., having 1 to 5 carbon atoms) esters thereof.

The polycarboxylic acid used may be a combination of a dicarboxylic acid, a dicarboxylic acid having a sulfonic acid group, and a dicarboxylic acid having an ethylenic double bond.

Any of these polycarboxylic acids may be used alone or in combination of two or more.

The polyhydric alcohol may be, for example, an aliphatic diol (e.g., a linear aliphatic diol with a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. In particular, the aliphatic diol is preferably 1,8-octanediol, 1,9-nonanediol, or 1,10-decanediol.

The polyhydric alcohol used may be a combination of a diol and a trihydric or higher polyhydric alcohol having a crosslinked or branched structure. Examples of the trihydric or higher polyhydric alcohol include glycerin, trimethylolethane, trimethylolpropane, and pentaerythritol.

Any of these polyhydric alcohols may be used alone or in combination of two or more.

In the polyhydric alcohol, the content of the aliphatic diol may be 80% by mole or more and preferably 90% by mole or more.

The melting temperature of the crystalline polyester resin is preferably from 50° C. to 100° C. inclusive, more preferably from 55° C. to 90° C. inclusive, and still more preferably from 60° C. to 85° C. inclusive.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The weight average molecular weight (Mw) of the crystalline polyester resin may be from 6,000 to 35,000 inclusive.

Like the amorphous polyester, the crystalline polyester resin is obtained by a well-known production method.

From the viewpoint of the scratch resistance of images, the weight average molecular weight (Mw) of the binder resin is preferably from 5,000 to 1,000,000 inclusive, more preferably from 7,000 to 500,000 inclusive, and particularly preferably from 25,000 to 60,000 inclusive. The number average molecular weight (Mn) of the binder resin is preferably from 2,000 to 100,000 inclusive. The molecular weight distribution Mw/Mn of the binder resin is preferably from 1.5 to 100 inclusive and more preferably from 2 to 60 inclusive.

The weight average molecular weight and number average molecular weight of the binder resin are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The content of the binder resin is preferably from 40% by mass to 95% by mass inclusive, more preferably from 50% by mass to 90% by mass inclusive, and still more preferably from 60% by mass to 85% by mass inclusive based on the total mass of the toner base particles.

When the toner base particles are white toner base particles, the content of the binder resin is preferably from 30% by mass to 85% by mass inclusive and more preferably from 40% by mass to 60% by mass inclusive based on the total mass of the white toner base particles.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

The melting temperature of the release agent is preferably from 50° C. to 110° C. inclusive and more preferably from 60° C. to 100° C. inclusive.

The melting temperature is determined using a DCS curve obtained by differential scanning calorimetry (DSC) from "peak melting temperature" described in melting temperature determination methods in "Testing methods for transition temperatures of plastics" in JIS K7121-1987.

The content of the release agent is preferably from 1% by mass to 20% by mass inclusive and more preferably from 5% by mass to 15% by mass inclusive based on the total mass of the toner base particles.

—5'-Chloro-3-hydroxy-2'-methoxy-2-naphthanilide—

From the viewpoint of reducing density unevenness in images to be obtained, the toner base particles may contain 5'-chloro-3-hydroxy-2'-methoxy-2-naphthanilide.

From the viewpoint of reducing density unevenness in images to be obtained, the mass content of 5'-chloro-3-hydroxy-2'-methoxy-2-naphthanilide in the toner for electrostatic image development according to the present exemplary embodiment is preferably from 1 ppm to 300 ppm inclusive, more preferably from 1 ppm to 250 ppm inclusive, still more preferably from 3 ppm to 250 ppm inclusive, and particularly preferably from 3 ppm to 200 ppm inclusive.

In the present exemplary embodiment, the content of 5'-chloro-3-hydroxy-2'-methoxy-2-naphthanilide is a value quantified by the following method.

A calibration curve prepared by measuring amounts of 5'-chloro-3-hydroxy-2'-methoxy-2-naphthanilide by liquid chromatography (LC-UV) is used to determine the content of 5'-chloro-3-hydroxy-2'-methoxy-2-naphthanilide in the toner. Specifically, 0.05 g of the toner is weighed, and tetrahydrofuran is added thereto. Then the mixture is subjected to ultrasonic extraction for 30 minutes. Then the extract is collected, and acetonitrile is added to adjust the volume of the mixture to 20 mL precisely. The solution prepared is used as a sample solution and subjected to measurement by liquid chromatography (LC-UV).

—Coloring Agent—

Examples of the coloring agent include: various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

Any of these coloring agents may be used alone or in combination of two or more.

The coloring agent used may be optionally subjected to surface treatment or may be used in combination with a dispersant. A plurality of coloring agents may be used in combination.

The content of the coloring agent is, for example, preferably from 1% by mass to 30% by mass inclusive and more preferably from 3% by mass to 15% by mass inclusive based on the total mass of the toner base particles.

From the viewpoint of reducing density unevenness in images to be obtained, the mass ratio ($M^C/M^N$) of the content $M^C$ of the coloring agent in the toner base particles to the content $M^N$ of 5'-chloro-3-hydroxy-2'-methoxy-2-naphthanilide is preferably from 50 to 10,000 inclusive, more preferably from 100 to 3,000 inclusive, and particularly preferably from 300 to 1,500 inclusive.

—Additional Additives—

Examples of additional additives include well-known additives such as a magnetic material, a charge control agent, and an inorganic powder. These additives are contained in the toner base particles as internal additives.

—Characteristics Etc. of Toner Base Particles—

The toner base particles may have a single layer structure or may be core-shell particles each having a so-called core-shell structure including a core (core particle) and a coating layer (shell layer) covering the core. The toner base particles having the core-shell structure may each include, for example: a core containing the binder resin and optional additives such as the coloring agent and the release agent; and a coating layer containing the binder resin.

From the viewpoint of reducing density unevenness in images to be obtained, it is preferable that the toner base particles are core-shell particles.

When the toner base particles are core-shell particles, the nonionic surfactant may be contained in both the core and the shell, from the viewpoint of reducing density unevenness in images to be obtained.

The volume average particle diameter ($D_{50v}$) of the toner is preferably from 2 μm to 10 μm inclusive and more preferably from 4 μm to 8 μm inclusive.

The volume average particle diameter of the toner is measured using Coulter Multisizer II (manufactured by Beckman Coulter, Inc.), and ISOTON-II (manufactured by Beckman Coulter, Inc.) is used as an electrolyte.

In the measurement, 0.5 mg to 50 mg of a measurement sample is added to 2 mL of a 5% by mass aqueous solution of a surfactant (preferably sodium alkylbenzenesulfonate) serving as a dispersant. The mixture is added to 100 mL to 150 mL of the electrolyte.

The electrolyte with the sample suspended therein is subjected to dispersion treatment for 1 minute using an ultrasonic dispersion apparatus, and then the diameters of particles within the range of 2 μm to 60 μm are measured using the Coulter Multisizer II with an aperture having an aperture diameter of 100 μm. The number of particles sampled is 50,000.

The particle diameters measured are used to obtain a volumetric cumulative distribution computed from the small diameter side, and the particle diameter at a cumulative frequency of 50% is defined as the volume average particle diameter $D_{50v}$.

In the present exemplary embodiment, no particular limitation is imposed on the average circularity of the toner base particles. However, from the viewpoint of improving the ease of cleaning the toner from an image-holding member, the average circularity is preferably from 0.91 to 0.98 inclusive, more preferably from 0.94 to 0.98 inclusive, and still more preferably from 0.95 to 0.97 inclusive.

In the present exemplary embodiment, the circularity of a toner base particle is (the peripheral length of a circle having the same area as a projection image of the particle/the peripheral length of the projection image of the particle). The average circularity of the toner base particles is the circularity when a cumulative frequency computed from the small diameter side in the circularity distribution is 50%. The average circularity of the toner base particles is determined by analyzing at least 3,000 toner base particles using a flow-type particle image analyzer.

When the toner base particles are produced, for example, by an aggregation/coalescence method, the average circularity of the toner base particles can be controlled by adjusting the stirring rate of a dispersion, the temperature of the dispersion, or the retention time in a fusion/coalescence step.

[Method for Producing Toner]

Next, a method for producing the toner according to the present exemplary embodiment will be described.

The toner according to the present exemplary embodiment is obtained by producing toner base particles and then externally adding the external additive to the toner base particles produced.

The toner base particles may be produced by a dry production method (such as a kneading-grinding method) or by a wet production method (such as an aggregation/coalescence method, a suspension polymerization method, or a dissolution/suspension method). No particular limitation is imposed on the production method, and any known production method may be used. In particular, the aggregation/coalescence method may be used to obtain the toner base particles.

In the kneading-grinding method, toner-forming materials including the nonionic surfactant, the binder resin, and the release agent and optionally including the coloring agent and 5'-chloro-3-hydroxy-2'-methoxy-2-naphthanilide are kneaded to obtain a kneaded mixture, and then the kneaded mixture is pulverized, whereby the toner particles are produced.

Specifically, when the toner base particles are produced, for example, by the aggregation/coalescence method, the toner base particles are produced through: the step of preparing a resin particle dispersion in which resin particles used as the binder resin are dispersed (a resin particle dispersion preparing step); the step of aggregating the resin particles (and other optional particles) in the resin particle dispersion (the dispersion may optionally contain an additional particle dispersion mixed therein) to form aggregated particles (an aggregated particle forming step); and the step of heating the aggregated particle dispersion with the aggregated particles dispersed therein to fuse and coalesce the aggregated particles to thereby form the toner base particles (a fusion/coalescence step).

5'-Chloro-3-hydroxy-2'-methoxy-2-naphthanilide may be added to the dispersion in the aggregated particle forming step.

These steps will next be described in detail.

In the following, a method for obtaining toner base particles containing the coloring agent and the release agent will be described, but the coloring agent and the release agent are used optionally. Of course, additional additives other than the coloring agent and the release agent may be used.

—Resin Particle Dispersion Preparing Step—

The resin particle dispersion in which the resin particles used as the binder resin are dispersed is prepared, and, for example, a coloring agent particle dispersion in which coloring agent particles are dispersed and a release agent particle dispersion in which release agent particles are dispersed are prepared.

The resin particle dispersion is prepared, for example, by dispersing the resin particles in a dispersion medium using a surfactant.

Examples of the dispersion medium used for the resin particle dispersion include aqueous mediums.

Examples of the aqueous medium include: water such as distilled water and ion exchanged water; and alcohols. Any of these may be used alone or in combination of two or more.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

In particular, it is preferable to use a nonionic surfactant, and it is also preferable to use a combination of a nonionic surfactant with an anionic surfactant or a cationic surfactant.

Any of these surfactants may be used alone or in combination of two or more.

To disperse the resin particles in the dispersion medium to form the resin particle dispersion, a commonly used dispersing method that uses, for example, a rotary shearing-type homogenizer, a ball mill using media, a sand mill, or a dyno-mill may be used. The resin particles may be dispersed in the dispersion medium by a phase inversion emulsification method, but this depends on the type of resin particles. In the phase inversion emulsification method, the resin to be dispersed is dissolved in a hydrophobic organic solvent that can dissolve the resin, and a base is added to an organic continuous phase (O phase) to neutralize it. Then the aqueous medium (W phase) is added to perform phase inversion from W/O to O/W, and the resin is thereby dispersed as particles in the aqueous medium.

The volume average particle diameter of the resin particles dispersed in the resin particle dispersion is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured by a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at which the cumulative frequency is 50% is measured as the volume average particle diameter D50v. The volume average particle diameters of particles in other dispersions are measured in the same manner.

The content of the resin particles contained in the resin particle dispersion is preferably from 5% by mass to 50% by mass inclusive and more preferably from 10% by mass to 40% by mass inclusive.

For example, the coloring agent particle dispersion and the release agent particle dispersion are prepared in a similar manner to the resin particle dispersion. Specifically, the descriptions of the volume average particle diameter of the particles in the resin particle dispersion, the dispersion medium for the resin particle dispersion, the dispersing method, and the content of the resin particles are applicable to the coloring agent particles dispersed in the coloring agent particle dispersion and the release agent particles dispersed in the release agent particle dispersion.

—Aggregated Particle Forming Step—

Next, the resin particle dispersion, the coloring agent particle dispersion, and the release agent particle dispersion are mixed. In this case, the nonionic surfactant may be mixed, and 5'-chloro-3-hydroxy-2'-methoxy-2-naphthanilide may also be mixed.

Then the resin particles, the coloring agent particles, and the release agent particles are hetero-aggregated in the dispersion mixture to form aggregated particles containing the resin particles, the coloring agent particles, and the release agent particles and having diameters close to the diameters of target toner base particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to a temperature close to the glass transition temperature of the resin particles (specifically, for example, a temperature from the glass transition temperature of the resin particles—30° C. to the glass transition temperature—10° C. inclusive) to aggregate the particles dispersed in the dispersion mixture to thereby form aggregated particles.

In the aggregated particle forming step, for example, while the dispersion mixture is agitated in a rotary shearing-type homogenizer, the flocculant is added at room temperature (e.g., 25° C.), and the pH of the dispersion mixture is adjusted to acidic (e.g., a pH of from 2 to 5 inclusive). The dispersion stabilizer may be optionally added, and the resulting mixture may be heated.

Examples of the flocculant include a surfactant with polarity opposite to the polarity of the surfactant contained in the dispersion mixture, inorganic metal salts, and divalent or higher polyvalent metal complexes. When a metal complex is used as the flocculant, the amount of the surfactant used can be reduced, and charging characteristics are improved.

An additive that forms a complex with a metal ion in the flocculant or a similar bond may be optionally used together with the flocculant. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the flocculant added is preferably from 0.01 parts by mass to 5.0 parts by mass inclusive and more preferably 0.1 parts by mass or more and less than 3.0 parts by mass based on 100 parts by mass of the resin particles.

—Fusion/Coalescence Step—

Next, the aggregated particle dispersion in which the aggregated particles are dispersed is heated, for example, to a temperature equal to or higher than the glass transition temperature of the resin particles (e.g., a temperature higher by 30° C. to 50° C. than the glass transition temperature of the resin particles) and equal to or higher than the melting temperature of the release agent to fuse and coalesce the aggregated particles to thereby form toner base particles.

In the fusion/coalescence step, the resin and the release agent are compatible with each other at the temperature equal to or higher than the glass transition temperature of the resin particles and equal to or higher than the melting temperature of the release agent. Then the dispersion is cooled to obtain a toner.

To control the aspect ratio of the release agent in the toner, the dispersion is held at a temperature around the freezing point of the release agent for a given time during cooling to grow the crystals of the release agent. Alternatively, two or more types of release agents with different melting temperatures are used. In this case, crystal growth during cooling can be facilitated, and the aspect ratio can be controlled.

The toner base particles are obtained through the above-described steps.

Alternatively, the toner base particles may be produced through: the step of, after the preparation of the aggregated particle dispersion containing the aggregated particles dispersed therein, mixing the aggregated particle dispersion further with the resin particle dispersion containing the resin particles dispersed therein and then causing the resin particles to adhere to the surface of the aggregated particles to aggregate them to thereby form second aggregated particles; and the step of heating a second aggregated particle dispersion containing the second aggregated particles dispersed therein to fuse and coalesce the second aggregated particles to thereby form toner base particles having the core-shell structure.

After completion of the fusion/coalescence step, the toner base particles formed in the solution are subjected to a well-known washing step, a solid-liquid separation step, and a drying step to obtain dried toner base particles. From the viewpoint of chargeability, the toner base particles may be subjected to displacement washing with ion exchanged water sufficiently in the washing step. From the viewpoint of productivity, suction filtration, pressure filtration, etc. may be performed in the solid-liquid separation step. From the viewpoint of productivity, freeze-drying, flash drying, fluidized drying, vibrating fluidized drying, etc. may be performed in the drying step.

The toner according to the present exemplary embodiment is produced, for example, by adding the external additive to the dried toner base particles obtained and mixing them. The mixing may be performed, for example, using a V blender, a Henschel mixer, a Loedige mixer, etc. If necessary, coarse particles in the toner may be removed using a vibrating sieving machine, an air sieving machine, etc.

<Electrostatic Image Developer>

An electrostatic image developer according to an exemplary embodiment contains at least the toner according to the preceding exemplary embodiment. The electrostatic image developer according to the present exemplary embodiment may be a one-component developer containing only the toner according to the preceding exemplary embodiment or may be a two-component developer containing a mixture of the toner and a carrier.

No particular limitation is imposed on the carrier, and a well-known carrier may be used. Examples of the carrier include: a coated carrier prepared by coating the surface of a core material formed of a magnetic powder with a resin; a magnetic powder-dispersed carrier prepared by dispersing a magnetic powder in a matrix resin; and a resin-impregnated carrier prepared by impregnating a porous magnetic powder with a resin. In each of the magnetic powder-dispersed carrier and the resin-impregnated carrier, the particles included in the carrier may be used as cores, and their surface may be coated with a resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins. The coating resin and the matrix resin may contain an additive such as electrically conductive particles. Examples of the electrically conductive particles include: particles of metals such as gold, silver, and copper; and particles of carbon black, titanium oxide, zinc oxide, tin oxide, barium sulfate, aluminum borate, and potassium titanate.

In particular, from the viewpoint of reducing density unevenness in images to be obtained, the carrier is preferably a carrier surface-coated with a resin containing a silicone resin and more preferably a carrier surface-coated with a silicone resin.

To coat the surface of the core material with a resin, the surface of the core material may be coated with a coating layer-forming solution prepared by dissolving the coating resin and various additives (used optionally) in an appropriate solvent. No particular limitation is imposed on the solvent, and the solvent may be selected in consideration of the type or resin used, ease of coating, etc. Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

<Image Forming Apparatus and Image Forming Method>

An image forming apparatus and an image forming method in an exemplary embodiment will be described.

The image forming apparatus in the present exemplary embodiment includes: an image holding member; charging means for charging the surface of the image holding member; electrostatic image forming means for forming an electrostatic image on the charged surface of the image holding member; developing means that contains an electrostatic image developer and develops the electrostatic image formed on the surface of the image holding member with the electrostatic image developer to thereby form a toner image; transferring means for transferring the toner image formed on the surface of the image holding member onto a recording medium; and fixing means for fixing the toner image transferred onto the recording medium. The electrostatic image developer used is the electrostatic image developer according to the preceding exemplary embodiment.

In the image forming apparatus in the present exemplary embodiment, an image forming method (an image forming method in the present exemplary embodiment) is performed. The image forming method includes: charging the surface of the image holding member; forming an electrostatic image on the charged surface of the image holding member; developing the electrostatic image formed on the surface of the image holding member with the electrostatic image developer according to the preceding exemplary embodiment to thereby form a toner image; transferring the toner image formed on the surface of the image holding member onto a recording medium; and fixing the toner image transferred onto the surface of the recording medium.

The image forming apparatus in the present exemplary embodiment may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including cleaning means for cleaning the surface of the image holding member after the transfer of the toner image but before charging; and an apparatus including charge eliminating means for eliminating charges on the surface of the image holding member after transfer of the toner image but before charging by irradiating the surface of the image holding member with charge eliminating light.

When the image forming apparatus in the present exemplary embodiment is the intermediate transfer-type apparatus, the transferring means includes, for example: an intermediate transfer body having a surface onto which a toner image is to be transferred; first transferring means for first-transferring a toner image formed on the surface of the image holding member onto the surface of the intermediate transfer body; and second transferring means for second-transferring the toner image transferred onto the surface of the intermediate transfer body onto the surface of a recording medium.

In the image forming apparatus in the present exemplary embodiment, for example, a portion including the developing means may have a cartridge structure (process cartridge) that is detachably attached to the image forming apparatus. The process cartridge used may be, for example, a process cartridge that includes the developing means containing the electrostatic image developer according to the preceding exemplary embodiment.

An example of the image forming apparatus in the present exemplary embodiment will be described, but this is not a limitation. In the following description, major components shown in FIG. 1 will be described, and description of other components will be omitted.

FIG. 1 is a schematic configuration diagram showing the image forming apparatus in the present exemplary embodiment.

The image forming apparatus shown in FIG. 1 includes first to fourth electrophotographic image forming units 10Y, 10M, 10C, and 10K (image forming means) that output yellow (Y), magenta (M), cyan (C), and black (K) images, respectively, based on color-separated image data. These image forming units (which may be hereinafter referred to simply as "units") 10Y, 10M, 10C, and 10K are arranged so as to be spaced apart from each other horizontally by a prescribed distance. These units 10Y, 10M, 10C, and 10K may each be a process cartridge detachable from the image forming apparatus.

An intermediate transfer belt (an example of the intermediate transfer body) 20 is disposed above the units 10Y, 10M, 10C, and 10K so as to extend through these units. The intermediate transfer belt 20 is wound around a driving roller 22 and a support roller 24 that are in contact with the inner surface of the intermediate transfer belt 20 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer belt cleaner 30 is disposed on an image holding surface of the intermediate transfer belt 20 so as to be opposed to the driving roller 22.

Yellow, magenta, cyan, and black toners contained in toner cartridges 8Y, 8M, 8C, and 8K, respectively, are supplied to developing devices (examples of the developing means) 4Y, 4M, 4C, and 4K, respectively, of the units 10Y, 10M, 10C, and 10K.

The first to fourth units 10Y, 10M, 10C, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y serving as an image holding member. A charging roller (an example of the charging means) 2Y, an exposure unit (an example of the electrostatic image forming means) 3, a developing device (an example of the developing means) 4Y, a first transfer roller 5Y (an example of the first transferring means), and a photoconductor cleaner (an example of image-holding member cleaning means) 6Y are disposed around the photoconductor 1Y in this order. The charging roller charges the surface of the photoconductor 1Y to a prescribed potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y. Bias power sources (not shown) for applying a first transfer bias are connected to the respective first transfer rollers 5Y, 5M, 5C, and 5K of the units. The bias power sources are controlled by an unillustrated controller to change the values of transfer biases applied to the respective first transfer rollers.

A yellow image formation operation in the first unit 10Y will be described.

First, before the operation, the surface of the photoconductor 1Y is charged by the charging roller 2Y to a potential of −600 V to −800 V.

The photoconductor 1Y is formed by stacking a photosensitive layer on a conductive substrate (with a volume resistivity of, for example, $1\times10^{-6}$ Ω cm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from an unillustrated controller. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is contained in the developing device 4Y. The yellow toner is agitated in the developing device 4Y and thereby frictionally charged. The charged yellow toner has a charge with the same polarity (negative polarity) as the charge on the photoconductor 1Y and is held on a developer roller (an example of a developer holding member). As the surface of the photoconductor 1Y passes through the developing device 4Y, the yellow toner electrostatically adheres to charge-eliminated latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias applied in this case has a (+) polarity opposite to the (−) polarity of the toner and is controlled to, for example, +10 μA in the first unit 10Y by the controller (not shown). The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a secondary transfer portion that is composed of the intermediate transfer belt 20, the support roller 24 in contact with the inner surface of the intermediate transfer belt, and a secondary transfer roller (an example of the second transferring means) 26 disposed on the image holding surface side of the intermediate transfer belt 20. A recording paper sheet (an example of the recording medium) P is supplied to a gap between the secondary transfer roller 26 and the intermediate transfer belt 20 in contact with each other at a prescribed timing through a supply mechanism, and a secondary transfer bias is applied to the support roller 24. The transfer bias applied in this case has the same polarity (−) as the polarity (−) of the toner, and an electrostatic force directed from the intermediate transfer belt 20 toward the recording paper sheet P acts on the toner image, so that the toner image on the intermediate transfer belt 20 is transferred onto the recording paper sheet P. In this case, the secondary transfer bias is determined according to a resistance detected by resistance detection means (not shown) for detecting the resistance of the secondary transfer portion and is voltage-controlled.

Then the recording paper sheet P with the toner image transferred thereon is transported to a press contact portion (nip portion) of a pair of fixing rollers in a fixing device (an example of the fixing means) 28, and the toner image is fixed onto the recording paper sheet P to thereby form a fixed image. The recording paper sheet P with the color image fixed thereon is transported to an ejection portion, and a series of the color image formation operations is thereby completed.

Examples of the recording paper sheet P onto which a toner image is to be transferred include plain paper sheets used for electrophotographic copying machines, printers, etc. Examples of the recording medium include, in addition to the recording paper sheets P, transparencies. To further improve the smoothness of the surface of a fixed image, it may be necessary that the surface of the recording paper sheet P be smooth. For example, coated paper prepared by coating the surface of plain paper with, for example, a resin, art paper for printing, etc. are suitably used.

<Process Cartridge and Toner Cartridge>

A process cartridge according to an exemplary embodiment includes developing means that contains the electrostatic image developer according to the preceding exemplary embodiment and develops an electrostatic image formed on the surface of an image holding member with the electrostatic image developer to thereby form a toner image. The process cartridge is detachable from the image forming apparatus.

The process cartridge according to the present exemplary embodiment may include the developing means and at least one optional unit selected from other means such as an image holding member, charging means, electrostatic image forming means, and transferring means.

An example of the process cartridge according to the present exemplary embodiment will be shown, but this is not a limitation. In the following description, major components shown in FIG. 2 will be described, and description of other components will be omitted.

Figure 2:
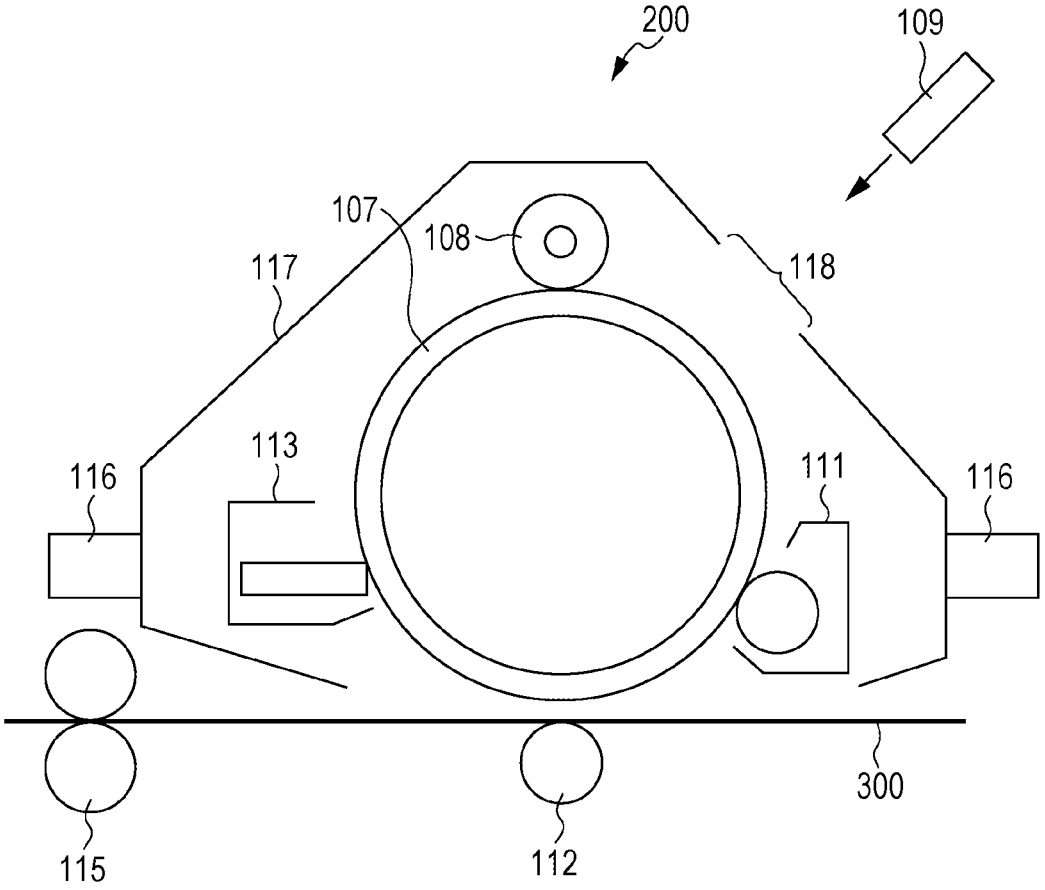
FIG. 2 is a schematic configuration diagram showing a process cartridge according to an exemplary embodiment.

FIG. 2 is a schematic configuration diagram showing an example of the process cartridge according to the present exemplary embodiment.

The process cartridge 200 shown in FIG. 2 includes, for example, a housing 117 including mounting rails 116 and an opening 118 for light exposure and further includes: a photoconductor 107 (an example of the image holding member); a charging roller 108 (an example of the charging means) disposed on the circumferential surface of the photoconductor 107; a developing device 111 (an example of the developing means); and a photoconductor cleaner 113 (an example of the cleaning means), which are integrally combined and held in the housing 117 to thereby form a cartridge.

In FIG. 2, 109 denotes an exposure unit (an example of the electrostatic image forming means), and 112 denotes a transferring device (an example of the transferring means). 115 denotes a fixing device (an example of the fixing means), and 300 denotes a recording paper sheet (an example of the recording medium).

Next, a toner cartridge according to an exemplary embodiment will be described.

The toner cartridge according to the present exemplary embodiment contains the toner according to the preceding exemplary embodiment and is detachably attached to the image forming apparatus. The toner cartridge contains a replenishment toner to be supplied to the developing means disposed in the image forming apparatus.

The image forming apparatus shown in FIG. 1 has a structure in which the toner cartridges 8Y, 8M, 8C, and 8K are detachably attached. The developing devices 4Y, 4M, 4C, and 4K are connected to their respective toner cartridges through unillustrated toner supply tubes. When the amount of the toner remaining in a toner cartridge is small, this toner cartridge is replaced.

EXAMPLES

Examples of the present disclosure will next be described. However, the present disclosure is not limited to these Examples. In the following description, "parts" and "%" are based on mass, unless otherwise specified.

The arithmetic mean particle diameter and average circularity of the specific external additive and the content of 5'-chloro-3-hydroxy-2'-methoxy-2-naphthanilide are measured by the methods described above.

<Production of Specific External Additive>

[Production of Silica Particles 1]

—Alkali Catalyst Solution Preparation Step [Preparation of Alkali Catalyst Solution (1)]—

A 2 L glass-made reaction vessel equipped with stirring blades, a dropping nozzle, and a thermometer is charged with 600 parts by mass of methanol and 90 parts by mass of 10% ammonia water, and they are stirred and mixed to obtain an alkali catalyst solution (1). The amount of the ammonia catalyst, i.e., the amount of $NH_3$ ($NH_3$ [mol]/($NH_3$+methanol+water) [L]), is 0.62 mol/L.

—Silica Particle Forming Step [Preparation of Silica Particle Suspension (1)]—

Next, the temperature of the alkali catalyst solution (1) is adjusted to 25° C., and the alkali catalyst solution (1) is purged with nitrogen. Then, while the alkali catalyst solution (1) is stirred at 120 rpm, dropwise addition of 350 parts by mass of tetramethoxysilane (TMOS) and dropwise addition of 150 parts by mass of ammonia water with a catalyst ($NH_3$) concentration of 4.44% by mass are started simultaneously at supply rates described below. Specifically, they are added dropwise over 20 minutes to obtain a suspension of silica particles (silica particle suspension (1)).

The supply rate of tetramethoxysilane (TMOS) with respect to the total number of moles of methanol in the alkali catalyst solution (1) is 15 g/min. The supply rate of 4.44 mass % ammonia water with respect to the total supply amount of tetraalkoxysilane per minute is 6.0 g/min.

250 Parts by mass of the solvent in the obtained silica particle suspension (1) is removed by thermal evaporation, and 250 parts by mass of pure water is added. The mixture is dried using a freeze dryer to thereby obtain silica particles.

—Hydrophobic Treatment of Silica Particles—

20 Parts by mass of trimethylsilane is added to 100 parts by mass of the hydrophilic silica particles (1), and the mixture is allowed to react at 150° C. for 2 hours to obtain irregularly-shaped hydrophobic silica particles with their surface subjected to hydrophobic treatment.

The silica particles obtained are used as silica particles 1.

[Production of Silica Particles 2]

Silica particles 2 are obtained in the same manner as in the production of the silica particles 1 except that 90 parts by mass of tetramethoxysilane (TMOS) and 40 parts by mass of 4.44 mass % ammonia water are used.

[Production of Silica Particles 3]

Silica particles 3 are obtained in the same manner as in the production of the silica particles 1 except that 530 parts by mass of tetramethoxysilane (TMOS) and 230 parts by mass of 4.44 mass % ammonia water are used.

[Production of Silica Particles 4]

Silica particles 4 are obtained in the same manner as in the production of the silica particles 1 except that 90 parts by mass of tetramethoxysilane (TMOS) and 40 parts by mass of 4.44 mass % ammonia water are used, that the supply rate of tetramethoxysilane (TMOS) with respect to the total number of moles of methanol in the alkali catalyst solution (1) is changed to 9 g/min, and that the supply rate of 4.44 mass % ammonia water with respect to the total supply amount of tetramethoxysilane per minute is changed to 5.0 g/min.

[Production of Silica Particles 5]

Silica particles 5 are obtained in the same manner as in the production of the silica particles 1 except that 530 parts by mass of tetramethoxysilane (TMOS) and 230 parts by mass of 4.44 mass % ammonia water are used, that the supply rate of tetramethoxysilane (TMOS) with respect to the total number of moles of methanol in the alkali catalyst solution (1) is changed to 20 g/min, and that the supply rate of 4.44 mass % ammonia water with respect to the total supply amount of tetramethoxysilane per minute is changed to 7.0 g/min.

[Production of Silica Particles 6]

Silica particles 6 are obtained in the same manner as in the production of the silica particles 1 except that 80 parts by mass of tetramethoxysilane (TMOS) and 40 parts by mass of 4.44 mass % ammonia water are used, that the supply rate of tetramethoxysilane (TMOS) with respect to the total number of moles of methanol in the alkali catalyst solution (1) is changed to 9 g/min, and that the supply rate of 4.44 mass % ammonia water with respect to the total supply amount of tetramethoxysilane per minute is changed to 5.0 g/min.

[Production of Silica Particles 7]

Silica particles 7 are obtained in the same manner as in the production of the silica particles 1 except that 550 parts by mass of tetramethoxysilane (TMOS) and 230 parts by mass of 4.44 mass % ammonia water are used, that the supply rate of tetramethoxysilane (TMOS) with respect to the total number of moles of methanol in the alkali catalyst solution (1) is changed to 9 g/min, and that the supply rate of 4.44 mass % ammonia water with respect to the total supply amount of tetramethoxysilane per minute is changed to 5.0 g/min.

[Production of Silica Particles 8]

Silica particles 8 are obtained in the same manner as in the production of the silica particles 1 except that 350 parts by mass of tetramethoxysilane (TMOS) and 150 parts by mass of 4.44 mass % ammonia water are used, that the supply rate of tetramethoxysilane (TMOS) with respect to the total number of moles of methanol in the alkali catalyst solution (1) is changed to 20 g/min, and that the supply rate of 4.44 mass % ammonia water with respect to the total supply amount of tetramethoxysilane per minute is changed to 7.0 g/min.

[Production of Silica Particles 9]

Silica particles 9 are obtained in the same manner as in the production of the silica particles 1 except that 350 parts by mass of tetramethoxysilane (TMOS) and 150 parts by mass of 4.44 mass % ammonia water are used, that the supply rate of tetramethoxysilane (TMOS) with respect to the total number of moles of methanol in the alkali catalyst solution (1) is changed to 9 g/min, and that the supply rate of 4.44 mass % ammonia water with respect to the total supply amount of tetramethoxysilane per minute is changed to 5.0 g/min.

[Production of Silica Particles 10]

Silica particles 10 are obtained in the same manner as in the production of the silica particles 1 except that 50 parts by mass of tetramethoxysilane (TMOS) and 30 parts by mass of 4.44 mass % ammonia water are used, that the supply rate of tetramethoxysilane (TMOS) with respect to the total number of moles of methanol in the alkali catalyst solution (1) is changed to 9 g/min, and that the supply rate of 4.44 mass % ammonia water with respect to the total supply amount of tetramethoxysilane per minute is changed to 5.0 g/min.

[Production of Silica Particles 11]

Silica particles 11 are obtained in the same manner as in the production of the silica particles 1 except that 600 parts by mass of tetramethoxysilane (TMOS) and 270 parts by mass of 4.44 mass % ammonia water are used, that the supply rate of tetramethoxysilane (TMOS) with respect to the total number of moles of methanol in the alkali catalyst solution (1) is changed to 20 g/min, and that the supply rate of 4.44 mass % ammonia water with respect to the total supply amount of tetramethoxysilane per minute is changed to 7.0 g/min.

[Production of Silica Particles 12]

Silica particles 12 are obtained in the same manner as in the production of the silica particles 1 except that 350 parts by mass of tetramethoxysilane (TMOS) and 150 parts by mass of 4.44 mass % ammonia water are used, that the supply rate of tetramethoxysilane (TMOS) with respect to the total number of moles of methanol in the alkali catalyst solution (1) is changed to 20 g/min, and that the supply rate of 4.44 mass % ammonia water with respect to the total supply amount of tetramethoxysilane per minute is changed to 7.0 g/min.

[Production of Silica Particles 13]

Silica particles 13 are obtained in the same manner as in the production of the silica particles 1 except that 350 parts by mass of tetramethoxysilane (TMOS) and 150 parts by mass of 4.44 mass % ammonia water are used, that the supply rate of tetramethoxysilane (TMOS) with respect to the total number of moles of methanol in the alkali catalyst solution (1) is changed to 9 g/min, and that the supply rate of 4.44 mass % ammonia water with respect to the total supply amount of tetramethoxysilane per minute is changed to 5.0 g/min.

The arithmetic mean particle diameters and average circularities of the silica particles obtained are shown in the following Table 1.

TABLE 1

| | Arithmetic mean particle diameter (nm) | Average circularity |
|---|---|---|
| Silica particles 1 | 250 | 0.65 |
| Silica particles 2 | 60 | 0.55 |
| Silica particles 3 | 380 | 0.75 |
| Silica particles 4 | 60 | 0.75 |
| Silica particles 5 | 380 | 0.55 |
| Silica particles 6 | 50 | 0.65 |
| Silica particles 7 | 400 | 0.65 |
| Silica particles 8 | 250 | 0.50 |
| Silica particles 9 | 250 | 0.80 |
| Silica particles 10 | 30 | 0.65 |
| Silica particles 11 | 500 | 0.65 |
| Silica particles 12 | 250 | 0.35 |
| Silica particles 13 | 250 | 0.85 |

<Production of Toner Base Particles>

—Preparation of Resin Particle Dispersion (1)—

Terephthalic acid: 30 parts by mole

Fumaric acid: 70 parts by mole

Bisphenol A-ethylene oxide adduct: 5 parts by mole

Bisphenol A-propylene oxide adduct: 95 parts by mole

A flask equipped with a stirrer, a nitrogen introduction tube, a temperature sensor, and a rectifying column is charged with the above materials, and the temperature of the mixture is increased to 220° C. over 1 hour. Then 1 part of titanium tetraethoxide is added to 100 parts of the above materials. While water generated is removed by evaporation, the temperature is increased to 230° C. over 30 minutes. A dehydration condensation reaction is continued at this temperature for 1 hour, and the reaction product is cooled. A polyester resin with a weight average molecular weight of 18,000 and a glass transition temperature of 60° C. is thereby obtained.

A container equipped with temperature controlling means and nitrogen purging means is charged with 40 parts of ethyl acetate and 25 parts of 2-butanol to prepare a solvent mixture, and 100 parts of the polyester resin is gradually added thereto and dissolved therein. A 10 mass % aqueous ammonia solution is added thereto (in a molar amount corresponding to three times the acid value of the resin), and the mixture is stirred for 30 minutes. Next, the container is purged with dry nitrogen, and the temperature is held at 40° C. While the solution mixture is stirred, 400 parts of ion exchanged water is added dropwise at a rate of 2 parts/minute. After completion of the dropwise addition, the mixture is returned to room temperature (20° C. to 25° C.), and dry nitrogen is bubbled for 48 hours under stirring to obtain a resin particle dispersion with the amounts of ethyl acetate and 2-butanol reduced to 1,000 ppm or less. Ion exchanged water is added to the resin particle dispersion to adjust the solid content to 20% by mass, whereby a resin particle dispersion (1) is obtained.

—Preparation of Coloring Agent Particle Dispersion (1)—

C.I. Pigment Blue 15:3 (manufactured by Dainichiseika Color & Chemicals Mfg. Co., Ltd.): 70 parts Nonionic surfactant (EMULGEN 150 manufactured by Kao Corporation): 5 parts Ion exchanged water: 200 parts The above materials are mixed and dispersed for 10 minutes using a homogenizer (product name: ULTRA-TURRAX T50 manufactured by IKA). Ion exchanged water is added such that the solid content in the dispersion is 20% by mass, and a coloring agent particle dispersion (1) containing, dispersed therein, coloring agent particles with a volume average particle diameter of 170 nm is thereby obtained.

—Preparation of Release Agent Particle Dispersion (1)—

Paraffin wax (HNP-9 manufactured by Nippon Seiro Co., Ltd.): 100 parts

Anionic surfactant (NEOGEN RK manufactured by DAI-ICHI KOGYO SEIYAKU Co., Ltd.): 1 part Ion exchanged water: 350 parts The above materials are mixed, heated to 100° C., dispersed using a homogenizer (product name: ULTRA-TURRAX T50 manufactured by IKA), and then subjected to dispersion treatment using a Manton-Gaulin high-pressure homogenizer (Gaulin Corporation) to thereby obtain a release agent particle dispersion (1) (solid content: 20% by mass) containing, dispersed therein, release agent particles with a volume average particle diameter of 200 nm.

—Production of Toner Base Particles (1)—

Resin particle dispersion (1): 403 parts

Coloring agent particle dispersion (1): 12 parts

Release agent particle dispersion (1): 50 parts

Anionic surfactant (TaycaPower manufactured by Tayca Corporation): 1 part

Nonionic surfactant (EMULGEN 150 manufactured by Kao Corporation): 1.5 parts

Naphthol AS-CA (5'-chloro-3-hydroxy-2'-methoxy-2-naphthanilide): 0.0003 parts

The above materials are placed in a stainless steel-made round bottom flask. 0.1N (=mol/L) nitric acid is added thereto to adjust the pH to 3.5, and 30 parts of an aqueous nitric acid solution with a polyaluminum chloride concentration of 10% by mass is added. Next, the mixture is dispersed at a solution temperature of 30° C. using a homogenizer (product name: ULTRA-TURRAX T50 manufactured by IKA), and the resulting mixture is heated to 45° C. in a heating oil bath and held for 30 minutes. Then 100 parts of the resin particle dispersion (1) is further added, and the mixture is held for 1 hour. Then a 0.1N aqueous sodium hydroxide solution is added to adjust the pH to 8.5, and the resulting mixture is heated to 84° C. and held for 2.5 hours. Next, the mixture is cooled to 20° C. at a rate of 20° C./minute, and solids are separated by filtration, sufficiently washed with ion exchanged water, and dried to thereby obtain toner base particles (1). The volume average particle diameter of the toner base particles (1) is 5.7 μm.

—Production of Toner Base Particles (2)—

Toner base particles (2) are obtained in the same manner as in the production of the toner base particles (1) except that 3 parts of the nonionic surfactant (EMULGEN 150 manufactured by Kao Corporation) is added.

—Production of Toner Base Particles (3)—

Toner base particles (3) are obtained in the same manner as in the production of the toner base particles (1) except that 0.5 parts of the nonionic surfactant (EMULGEN 150 manufactured by Kao Corporation) is added.

—Production of Toner Base Particles (4)—

Toner base particles (4) are obtained in the same manner as in the production of the toner base particles (1) except that 1.5 parts of a nonionic surfactant (EMULGEN A-60 manufactured by Kao Corporation) and 0.0003 parts of the Naphthol AS-CA (5'-chloro-3-hydroxy-2'-methoxy-2-naphthanilide) are added.

—Production of Toner Base Particles (5)—

Toner base particles (5) are obtained in the same manner as in the production of the toner base particles (1) except that 1.5 parts of a nonionic surfactant (SURFLON 5-241 manufactured by AGC SEIMI CHEMICAL Co., Ltd.) and 0.0003 parts of the Naphthol AS-CA (5'-chloro-3-hydroxy-2'-methoxy-2-naphthanilide) are added.

—Production of Toner Base Particles (6)—

Toner base particles (6) are obtained in the same manner as in the production of the toner base particles (1) except that 0.01 parts of the Naphthol AS-CA (5'-chloro-3-hydroxy-2'-methoxy-2-naphthanilide) is added.

—Production of Toner Base Particles (7)—

Toner base particles (7) are obtained in the same manner as in the production of the toner base particles (1) except that 0.025 parts of the Naphthol AS-CA (5'-chloro-3-hydroxy-2'-methoxy-2-naphthanilide) is added.

—Production of Toner Base Particles (8)—

Toner base particles (8) are obtained in the same manner as in the production of the toner base particles (1) except that 30 parts of the coloring agent particle dispersion (1) is added.

—Production of Toner Base Particles (9)—

Toner base particles (9) are obtained in the same manner as in the production of the toner base particles (1) except that 5 parts of the coloring agent particle dispersion (1) and 0.01 parts of the Naphthol AS-CA (5'-chloro-3-hydroxy-2'-methoxy-2-naphthanilide) are added.

—Production of Toner Base Particles (10)—

Toner base particles (10) are obtained in the same manner as in the production of the toner base particles (1) except that 0.3 parts of the nonionic surfactant (EMULGEN 150 manufactured by Kao Corporation) and 0.01 parts of the Naphthol AS-CA (5'-chloro-3-hydroxy-2'-methoxy-2-naphthanilide) are added.

—Production of Toner Base Particles (11)—

Toner base particles (11) are obtained in the same manner as in the production of the toner base particles (1) except that 3.5 parts of the nonionic surfactant (EMULGEN 150 manufactured by Kao Corporation) and 0.01 parts of the Naphthol AS-CA (5'-chloro-3-hydroxy-2'-methoxy-2-naphthanilide) are added.

—Production of Toner Base Particles (12)—

Toner base particles (12) are obtained in the same manner as in the production of the toner base particles (1) except that 0 parts of the nonionic surfactant (EMULGEN 150 manufactured by Kao Corporation) and 2 parts of an anionic surfactant (TaycaPower manufactured by Tayca Corporation) are added.

—Production of Toner Base Particles (13)—

Polyester resin (linear polyester prepared by condensation polymerization of terephthalic acid/bisphenol A-ethylene oxide adduct/cyclohexanedimethanol, Mn=4,000, Mw=12,000, Tg=62° C.): 100 parts C.I. Pigment Blue 15:3 (manufactured by Dainichiseika Color & Chemicals Mfg. Co., Ltd.): 4 parts Naphthol AS-CA (5'-chloro-3-hydroxy-2'-methoxy-2-naphthanilide): 0.00003 parts The above components are pre-mixed sufficiently in a Henschel mixer, melt-kneaded in a biaxial roll mill, cooled, then finely pulverized using a jet mill, and subjected to classification twice using a pneumatic classifier to thereby produce cyan toner base particles (13) with an average particle diameter of 6.5 μm.

<Production of Carrier 1>

Ferrite particles (average particle diameter: 35 μm): 100 parts

Toluene: 14 parts

Polymethyl methacrylate (MMA, weight average molecular weight: 75,000): 5 parts

Carbon black: 0.2 parts (VXC-72 manufactured by Cabot Corporation, volume resistivity: 100 Ωcm or less)

The above materials except for the ferrite particles are dispersed in a sand mill to prepare a dispersion, and the dispersion and the ferrite particles are placed in a vacuum degassed-type kneader and dried under reduced presser while the mixture is stirred to thereby obtain a carrier 1.

<Production of Carrier 2>

Ferrite particles (average particle diameter: 35 μm): 100 parts

Toluene: 14 parts

Silicone resin (SIL, SR2410, manufactured by Dow Corning Toray Co., Ltd.): 2 parts Carbon black: 0.2 parts (VXC-72 manufactured by Cabot Corporation, volume resistivity: 100 Ωcm or less)

The above materials except for the ferrite particles are dispersed in a sand mill to prepare a dispersion, and the dispersion and the ferrite particles are placed in a vacuum degassed-type kneader and dried under reduced presser while the mixture is stirred to thereby obtain a carrier 2.

Example 1

<Production of Toner>

100 Parts by mass of the toner base particles (1) obtained, 1.5 parts by mass of the silica particles 1, and 1.0 part by mass of hydrophobic titanium oxide (T805 manufactured by Nippon Aerosil Co., Ltd.) are mixed using a sample mill at 10,000 rpm for 30 seconds. Then the mixture is sieved using a vibrating sieve with a mesh size of 45 μm to prepare a toner 1 (toner for electrostatic image development). The volume average particle diameter of the toner 1 obtained is 5.7 μm.

<Production of Electrostatic Image Developer>

8 Parts of the toner 1 and 92 parts of the carrier 1 are mixed in a V blender to produce a developer 1 (electrostatic image developer).

Examples 2 to 31 and Comparative Examples 1 to 7

Toners for electrostatic image development and electrostatic image developers are produced in the same manner as in Example 1 except that the types of toner base particles and silica particles and the contents of the nonionic surfactant, the toner base particles, the silica particles, and 5'-chloro-3-hydroxy-2'-methoxy-2-naphthanilide are changed as shown in Tables 2 and 3.

The toners for electrostatic image development and electrostatic image developers obtained in Examples 1 to 31 and Comparative Examples 1 to 7 are used to perform the following evaluation. The results of the evaluation are summarized in Tables 2 and 3.

<Evaluation of Reduction in Density Unevenness>

The DocuCentre Color 400 manufactured by Fuji Xerox Co., Ltd. is used as an image forming apparatus for forming evaluation images. After an image is outputted on 10,000 sheets using only a cyan toner (area coverage: 1%) in a high-temperature high-humidity environment, an image with a white toner density of 100% and an image with a cyan toner density of 100% are printed on a sheet, and the deviation ΔEave from the target hue is computed. The evaluation criteria are shown below. The smaller the value of ΔEave, the higher the ability to reduce density unevenness.

A: ΔEave<1.0

B: 1.0≤ΔEave<2

C: 2≤ΔEave<3

D: 3≤ΔEave

TABLE 2

| | Content of nonionic surfactant (% by mass) | Toner base particles | Specific external additive: Type of silica | Specific external additive: Amount added (parts by mass) | Content of 5'-chloro-3-hydroxy-2'-methoxy-2-naphthanilide (ppm) | $M^C/M^N$ | Coating resin for carrier | Reduction in density unevenness |
|---|---|---|---|---|---|---|---|---|
| Example 1 | 0.5 | Base particles (1) | Silica particles 1 | 1.5 | 3 | 1,000 | MMA | A |
| Example 2 | 0.5 | Base particles (1) | Silica particles 2 | 1 | 3 | 1,000 | MMA | A |
| Example 3 | 0.5 | Base particles (1) | Silica particles 3 | 2 | 3 | 1,000 | MMA | A |
| Example 4 | 0.5 | Base particles (1) | Silica particles 4 | 1 | 3 | 1,000 | MMA | B |
| Example 5 | 0.5 | Base particles (1) | Silica particles 5 | 2 | 3 | 1,000 | MMA | B |
| Example 6 | 0.5 | Base particles (1) | Silica particles 6 | 1 | 3 | 1,000 | MMA | B |
| Example 7 | 0.5 | Base particles (1) | Silica particles 7 | 2 | 3 | 1,000 | MMA | B |

TABLE 2-continued

| | Content of nonionic surfactant (% by mass) | Toner base particles | Specific external additive: Type of silica | Specific external additive: Amount added (parts by mass) | Content of 5'-chloro-3-hydroxy-2'-methoxy-2-naphthanilide (ppm) | $M^C/M^N$ | Coating resin for carrier | Reduction in density unevenness |
|---|---|---|---|---|---|---|---|---|
| Example 8 | 0.5 | Base particles (1) | Silica particles 8 | 1.5 | 3 | 1,000 | MMA | B |
| Example 9 | 0.5 | Base particles (1) | Silica particles 9 | 1.5 | 3 | 1,000 | MMA | B |
| Example 10 | 0.9 | Base particles (2) | Silica particles 1 | 1.5 | 3 | 1,000 | MMA | A |
| Example 11 | 0.9 | Base particles (2) | Silica particles 2 | 1 | 3 | 1,000 | MMA | B |
| Example 12 | 0.9 | Base particles (2) | Silica particles 3 | 2 | 3 | 1,000 | MMA | B |
| Example 13 | 0.9 | Base particles (2) | Silica particles 4 | 1 | 3 | 1,000 | MMA | B |
| Example 14 | 0.9 | Base particles (2) | Silica particles 5 | 2 | 3 | 1,000 | MMA | B |
| Example 15 | 0.1 | Base particles (3) | Silica particles 1 | 1.5 | 3 | 1,000 | MMA | A |
| Example 16 | 0.1 | Base particles (3) | Silica particles 2 | 1 | 3 | 1,000 | MMA | B |
| Example 17 | 0.1 | Base particles (3) | Silica particles 3 | 2 | 3 | 1,000 | MMA | B |
| Example 18 | 0.1 | Base particles (3) | Silica particles 4 | 1 | 3 | 1,000 | MMA | B |
| Example 19 | 0.1 | Base particles (3) | Silica particles 5 | 2 | 3 | 1,000 | MMA | B |
| Example 20 | 0.5 | Base particles (4) | Silica particles 1 | 1.5 | 3 | 1,000 | MMA | A |

TABLE 3

| | Content of nonionic surfactant (% by mass) | Toner base particles | Specific external additive: Type of silica | Specific external additive: Amount added (parts by mass) | Content of 5'-chloro-3-hydroxy-2'-methoxy-2-naphthanilide (ppm) | $M^C/M^N$ | Coating resin for carrier | Reduction in density unevenness |
|---|---|---|---|---|---|---|---|---|
| Example 21 | 0.5 | Base particles (5) | Silica particles 1 | 1.5 | 3 | 1,000 | MMA | A |
| Example 22 | 0.5 | Base particles (1) | Silica particles 1 | 1.5 | 3 | 1,000 | SIL | A |
| Example 23 | 0.5 | Base particles (1) | Silica particles 2 | 1 | 3 | 1,000 | SIL | A |
| Example 24 | 0.5 | Base particles (1) | Silica particles 3 | 2 | 3 | 1,000 | SIL | A |
| Example 25 | 0.5 | Base particles (6) | Silica particles 2 | 1 | 150 | 1,000 | MMA | A |
| Example 26 | 0.5 | Base particles (7) | Silica particles 3 | 2 | 250 | 1,000 | MMA | A |
| Example 27 | 0.5 | Base particles (1) | Silica particles 1 | 1.5 | 0.3 | 1,000 | MMA | B |
| Example 28 | 0.5 | Base particles (13) | Silica particles 1 | 1.5 | 3 | 1,000 | MMA | B |
| Example 29 | 0.5 | Base particles (1) | Silica particles 1 | 7 | 3 | 1,000 | MMA | B |
| Example 30 | 0.5 | Base particles (8) | Silica particles 1 | 1.5 | 3 | 8,000 | MMA | B |
| Example 31 | 0.5 | Base particles (9) | Silica particles 1 | 1.5 | 3 | 70 | MMA | B |
| Comparative Example 1 | 0.03 | Base particles (10) | Silica particles 1 | 1.5 | 100 | 1,000 | MMA | C |
| Comparative Example 2 | 1.2 | Base particles (11) | Silica particles 1 | 1.5 | 100 | 1,000 | MMA | C |
| Comparative Example 3 | 0.5 | Base particles (6) | Silica particles 10 | 1 | 100 | 1,000 | MMA | D |
| Comparative Example 4 | 0.5 | Base particles (6) | Silica particles 11 | 3 | 100 | 1,000 | MMA | D |

TABLE 3-continued

| | Content of nonionic surfactant (% by mass) | Toner base particles | Specific external additive: Type of silica | Specific external additive: Amount added (parts by mass) | Content of 5'-chloro-3-hydroxy-2'-methoxy-2-naphthanilide (ppm) | $M^C/M^N$ | Coating resin for carrier | Reduction in density unevenness |
|---|---|---|---|---|---|---|---|---|
| Comparative Example 5 | 0.5 | Base particles (6) | Silica particles 12 | 1.5 | 100 | 1,000 | MMA | D |
| Comparative Example 6 | 0.5 | Base particles (6) | Silica particles 13 | 1.5 | 100 | 1,000 | MMA | D |
| Comparative Example 7 | 0 | Base particles (12) | Silica particles 1 | 1.5 | 3 | 1,000 | MMA | D |

As can be seen from the results shown in Tables 2 and 3, the ability of the toners for electrostatic image development in the Examples to reduce density unevenness in images to be obtained is higher than that of the toners for electrostatic image development in the Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for electrostatic image development, comprising:

toner base particles containing at least a nonionic surfactant, a binder resin, and a release agent; and an external additive, wherein a content of the nonionic surfactant is from 0.05% by mass to 1% by mass inclusive based on a total mass of the toner, and wherein the external additive contains inorganic particles having an arithmetic mean particle diameter of from 50 nm to 400 nm inclusive and an average circularity of from 0.5 to 0.8 inclusive.

2. The toner for electrostatic image development according to claim 1, wherein the toner base particles further contain a coloring agent.

3. The toner for electrostatic image development according to claim 1, wherein the toner base particles further contain 5'-chloro-3-hydroxy-2'-methoxy-2-naphthanilide.

4. The toner for electrostatic image development according to claim 3, wherein the content of the 5'-chloro-3-hydroxy-2'-methoxy-2-naphthanilide is from 1 ppm to 300 ppm inclusive based on the total mass of the toner.

5. The toner for electrostatic image development according to claim 3, wherein a mass ratio ($M^C/M^N$) of a content $M^C$ of the coloring agent in the toner base particles to a content $M^N$ of the 5'-chloro-3-hydroxy-2'-methoxy-2-naphthanilide in the toner base particles is from 50 to 10,000 inclusive.

6. The toner for electrostatic image development according to claim 1, wherein the binder resin contains an amorphous resin having a polyester resin segment and a styrene-acrylic copolymer segment.

7. The toner for electrostatic image development according to claim 1, wherein the nonionic surfactant is a compound having a polyalkyleneoxy structure.

8. The toner for electrostatic image development according to claim 7, wherein the nonionic surfactant is a compound having a polyethyleneoxy structure.

9. The toner for electrostatic image development according to claim 1, wherein an amount of the external additive added is from 0.01% by mass to 10% by mass inclusive based on the mass of the toner base particles.

10. The toner for electrostatic image development according to claim 1, wherein the inorganic particles are silica particles.

11. The toner for electrostatic image development according to claim 1, wherein the binder resin contains a crystalline resin.

12. The toner for electrostatic image development according to claim 1, wherein the toner base particles are core-shell particles.

13. An electrostatic image developer comprising the toner for electrostatic image development according to claim 1.

14. A toner cartridge comprising the toner for electrostatic image development according to claim 1, the toner being housed in the toner cartridge, the toner cartridge being detachably attached to an image forming apparatus.

* * * * *